US005899458A

United States Patent [19]

Moore

[11] Patent Number: 5,899,458

[45] Date of Patent: May 4, 1999

[54] METHOD OF PLAYING A BLACKJACK GAME

[76] Inventor: James Chyvan Moore, 68-680 Dinah Shore Dr. Apt. 69-A, Cathedral City, Calif. 92234

[21] Appl. No.: 09/098,586

[22] Filed: Jun. 17, 1998

[51] Int. Cl.[6] ..... A63F 1/00

[52] U.S. Cl. ..... 273/292

[58] Field of Search ..... 273/292, 274; 463/12

[56] References Cited

U.S. PATENT DOCUMENTS 5,013,049 5/1991 Tomaszewki ..... 273/292

5,660,391 8/1997 Klassee ..... 273/292

*Primary Examiner*—Benjamin H. Layno

[57] ABSTRACT

Lucky Pick Blackjack uses a new method of delivering all cards to the various players, both for starting hands and subsequent draws. Using a unique set of domino cards, the deal is designed to set up all hands in a manner where the play of all players can in no way affect other player hands or the dealer's hand. This, in turn, eliminates most player hostility, for it neutralizes any effect any player may have on the end result of winning or losing for all players involved.

2 Claims, 1 Drawing Sheet

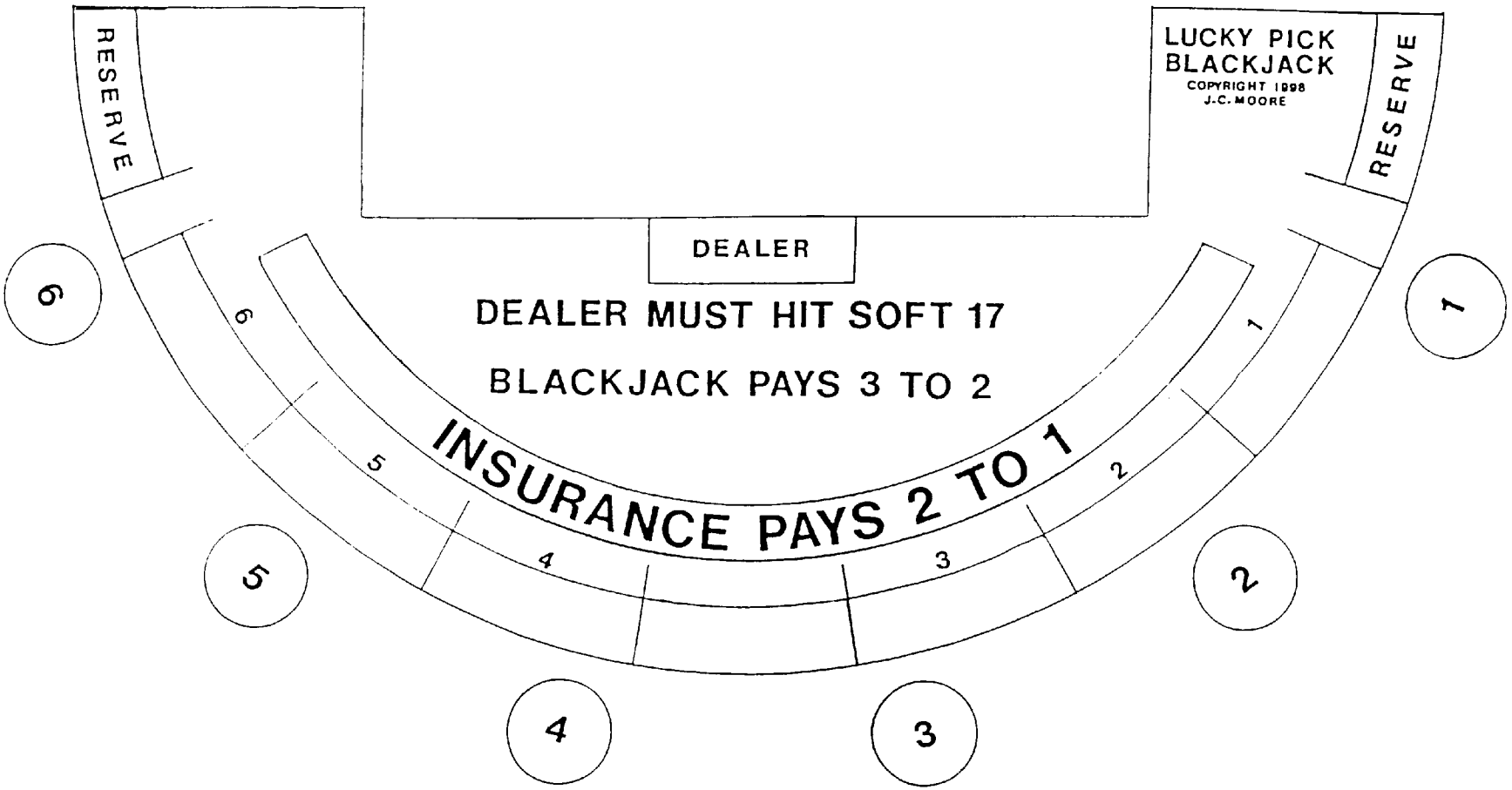
LUCKY PICK
BLACKJACK
COPYRIGHT 1998
J.C. MOORE
RESERVE
DEALER
DEALER MUST HIT SOFT 17
BLACKJACK PAYS 3 TO 2
INSURANCE PAYS 2 TO 1
1
2
3
4
5
6
RESERVE
1
2
3
4
5
6

METHOD OF PLAYING A BLACKJACK GAME

BACKGROUND OF THE INVENTION

This invention relates to the casino table game of Blackjack and its need for improvements.

Blackjack has chronic problems which have a negative effect on the players, the dealers, and the casino.

The basic playing strategies used by various players can have a direct bearing on all players involved in each hand.

Many players feel their method of play is the only correct method. They often threaten, chastise and humiliate all players choosing to play differently.

Right or wrong, these "experts" feel incorrect play by others are the direct cause of their losing sessions. Good players and bad players often chase each other from the table by their hostilities. This can create problems for all involved.

The casino loses customers. Sometimes the dealer must referee the players' arguments, while the anticipation of a pleasant evening of Blackjack turns into a nightmare of unpleasantness for the players.

In extreme cases, fights between players could culminate in some players going to jail. A side effect could be overturned tables, scattered chips, disrupted play and loss of additional customers for the casino.

Sometimes players suspect the dealer may be cheating them. Innocent dealers may suffer unfair verbal abuse from unruly players.

Many casinos are on constant lookout for suspected card counters. This can sometimes lead to casino harassment of innocent players. This, in turn, projects a bad impression of the casino to all players.

BRIEF SUMMARY OF THE INVENTION

Lucky Pick Blackjack distributes extra cards to all players at the start of each Blackjack hand. These extra cards enable all players to finish play of their hands in a manner that should never upset other players.

It also utilizes the use of domino cards, or tiles, to create additional options to enhance the pleasure, fun and excitement for all players.

The ultimate object of this game is to neutralize the ever-present hostilities now found in all Blackjack games as they are presently played.

The end product is a congenial and relaxing game that is the epitome of fair play.

The object of giving players a choice of the cards they draw is to create a greater feeling of participation in the game. It gives them an opportunity to have an extra influence on the end result of every hand they play.

BRIEF DESCRIPTION OF THE DRAWING

The drawing is a special game board designed to be used with domino cards. This board will lay flat on top of any casino-type Blackjack table.

The numbered circles at the outer edge are the players' betting areas.

The inner numbered areas are designed to hold six cards for each player's hand.

The reserve areas are designed to hold five cards each for a total of ten reserve cards.

The dealer area is designed to hold six cards for the dealer's hand.

The double line directly outside the players' card areas and reserve areas is a one-half inch raised ridge to contain the card dominoes. This ridge also extends across the back side for the same purpose.

The game board is designed to straddle the dealer's tray. The board leaves room at the back side for the casino cash drop box.

The three playing rules on the board are designed to meet regulatory requirements of various state gaming commissions.

The board is a half circle with a 25 inch radius centered on the plane of its back edge. The last eight inches of the outside edge of the circle will be cut parallel to the dealer's tray leaving the back edge of the board 45 inches across.

Note: Three domino cards are included in a small manila envelope to permit a better perception of the game.

DETAILED DESCRIPTION OF THE INVENTION

Lucky Pick Blackjack is played with a 52 card deck of card dominoes consisting of the standard four suits of Spades, Hearts, Diamonds and Clubs. Each suit will have the standard thirteen ranks of Ace through King, thereby creating the 52 card total.

Card dominoes are the physical structure of a regular domino (tile) with the standard set of playing cards stamped on the face side. Hereafter these domino cards will be referred to simply as "cards."

Only the dealer shall be allowed to touch these cards. These cards shall never leave the playing surface of the special Lucky Pick Playing Board.

This playing board shall be made up of a half circle with a 20 inch inside radius plus a one-half inch raised outer edge to contain the cards within that half circle.

The center for the 20 inch radius shall be the center of the dealer's chip tray and six inches back from the front of that tray.

Six inches shall be removed from the back center of the game board to allow it to straddle the dealer's tray. This will allow about 14 inches of playing surface between the front of the dealer's tray and the apex of the playing board.

The inside edge of the circle shall have six designated areas for each of the six playing spots. Each area shall be six inches long and two inches wide to accommodate six playing cards placed side by side.

Starting at the dealer's left, these areas will be numbered one through six, with numbers one, two and three for players on the dealer's left, and numbers four, five and six for players on the dealer's right.

Two additional areas inside the circle will be designated Reserve Areas. These areas will be located to the extreme left of the dealer and the extreme right. These areas are designed to hold five cards each or ten cards total and will constitute the Reserve Cards for all players and the dealer. These areas will be marked "Reserve."

There shall be a two inch by six inch area directly in front of the dealer's box marked "Dealer." The dealer's six cards will be placed in this area.

To start play, dealer shall mix the 52 cards and push them all to the outer edge of the circle on the playing board surface. Six cards shall be placed perpendicular to the circle and side by side in each player's designated area. Players are never permitted to touch their cards.

Dealer then places five cards in each Reserve area and returns the remaining six cards to the dealer area.

Once all cards are in place, the dealer will start with the first player on dealer's left and turn the first two cards up to form that player's starting hand.

The dealer will then proceed clockwise around the table and take the same action with all other player hands.

Dealer then turns his first card on the right side of his area. This card becomes dealer's up card and the second card shall be his hole card.

Anytime a player wishes to draw to their starting hand, they may choose any of their remaining cards for the dealer to turn.

Since players are not allowed to touch their cards, a pointer will be provided for them to specifically designate their card they wish the dealer to turn. Players may choose each succeeding draw until the players' cards are exhausted.

If a player exhausts the six cards, the dealer will provide additional cards from the Reserve on that player's side of the table, starting with the front card first and proceeding in order.

Should a player's Reserve be exhausted, the player shall always receive the first unused players' cards to his right.

After all players have completed their hands, the dealer shall turn his second card up to complete his starting hand.

When drawing, the dealer must draw all his remaining cards in order. When his cards are exhausted, he will draw Reserve cards just as the players do, first from the Reserve on his left, then the Reserve on his right, then the first unused players' cards to his immediate right. No unused players' cards shall ever be used until each player's Reserve cards are exhausted.

After all winning and losing bets are processed, the dealer will return all cards to center board face down and proceed to the next round of play.

Any player may play as many hands as spots are available, simply by placing their bet first on their own betting circle and then on any unused adjacent betting circle. The card area number must always match the betting circle number for every hand played.

All other standard Blackjack playing rules of the host casino shall apply.

I claim:

1. A method of playing a blackjack game in a casino between a dealer and a plurality of players comprising the steps of:

providing at least one conventional deck of 52 playing cards, each card having a numerical value;

providing a playing board having a dealer area and having a plurality of designated areas;

assigning the dealer area to the dealer, and assigning one designated area to each player of the plurality of players;

the dealer initially dealing six cards face down to each player at their assigned designated area, wherein each player receiving six face down cards, dealing six face down cards to the dealer area, and returning the remaining undealt cards to the dealer area;

the dealer, starting with a first player, turning face up two cards from the first player's six face down cards to form the first player's starting hand, the dealer then, one at a time, turning face up two cards from each of the other players' six face down cards to form the starting hands of all the other players;

the dealer then turning face up a first card from the dealer's six face down cards and assigning one of the remaining dealer's face down cards as a hole card to form the dealer's starting hand;

allowing each player electing either to stand and having no more cards of the remaining face down cards in their designated area to be turned face up, or electing not to stand and having the dealer turn face up one or more of the remaining face down cards in their designated area to add to their starting hand in order to reach a predetermined numerical total in accordance with the conventional play of blackjack;

each player completing their hand by standing and having no more cards of the remaining face down cards in their designated area to be turned face up according to predetermined blackjack rules set forth by the casino;

after all players have completed their hands, the dealer turning face up the hole card;

requiring the dealer to either stand and have no more of the remaining dealer's face down cards turned face up, or not to stand and having the dealer turn face up one or more cards of the remaining dealer's face down cards to add to the dealer's starting hand in accordance with predetermined blackjack rules set forth by the casino;

after the player has completed the dealer's hand, determining a winner between the dealer and each player by comparing the dealer's completed hand to each of the players' completed hands, one at a time, in accordance with blackjack rules set forth by the casino.

2. The method of playing a blackjack game according to claim 1, further comprising the steps of:

providing a plurality of reserve areas on said playing board, locating said reserve areas in locations remote from said dealer area and said designated area;

the dealer, after having dealt six face down cards to the dealer and to each of the plurality of players, dealing five cards face down to each of the reserve areas;

if all six previously face down cards of a player are turned face up, and the player still requests additional cards, the dealer turning over one or more face down cards from a reserve area to add to the player's hand;

if all six previously face down cards of the dealer are turned face up, and if the dealer's hand still requires additional cards according to the predetermined blackjack rules set forth by the casino, the dealer turning over one or more face down cards from a reserve area to add to the dealer's hand.

* * * * *